United States Patent [19]

Gauthier et al.

[11] 4,416,105

[45] Nov. 22, 1983

[54] TRAINING DEVICE FOR HORSES

[76] Inventors: Yves Gauthier, 7433 St. Vincent, Ste. Scholastique, Mirabel, Quebec, Canada, J0N 1S0; Robert Gravel, 3195 Dickson Ave., Montreal, Quebec, Canada, H1N 2J9

[21] Appl. No.: 304,177

[22] Filed: Sep. 21, 1981

[51] Int. Cl.[3] ..... B68B 1/00

[52] U.S. Cl. ..... 54/71

[58] Field of Search ..... 54/1, 10, 71; 119/29

[56] References Cited

U.S. PATENT DOCUMENTS 771,226 10/1904 Berry ..... 54/71

988,152 3/1911 Sund ..... 54/1

1,372,411 3/1921 Ferch ..... 54/1

*Primary Examiner*—Robert P. Swiatek

*Attorney, Agent, or Firm*—Murray Schaffer

[57] ABSTRACT

A horse training pressure plate comprising a flat backing plate with a pad of sponge-like material affixed to one side of the backing plate, is provided. A plurality of pins of slightly lesser length than the thickness of the pad, project from the backing plate within the pad and mounting brackets on the side of the backing plate opposite the pad for maintaining of a pressure plate on the head poles.

3 Claims, 5 Drawing Figures

TRAINING DEVICE FOR HORSES

This invention relates to a pair of pressure training plates adapted to be mounted on the head poles of a race horse, adjacent its neck, in order to encourage the race horse to maintain its neck and head in a straight forward position, during training, so that during a race the horse will instinctively maintain its head in a straight forward position.

In the past attempts have been made to train horses to run with neck and head pointing forwardly, without deviation, using restraints which subject the animal to electrical shock in the event that its head or neck turns to one side, or using metallic braces or the like, to prevent the horse from bending head or neck.

The present invention utilizes a pair of comfortable sponge pads mounted on stiff backings which in turn are supported on the head poles on either side of a horse's neck. Mounted on the backing, within the sponge material are a plurality of pins, which are capable of projection through the sponge material so as to press against the skin of the horse's neck, without puncturing the skin, but causing sufficient pain to encourage the horse to maintain its neck in a straight forward position, to avoid the pain caused by the restraint should the horse veer its head to either side. Thus, with the use of the pressure plate according to the invention the horse may place minor pressure on the airform or sponge pad, without feeling any discomfort, but when its head is turned to more than a minor degree, causes itself considerable discomfort.

It is an object of the invention to provide a horse training device comprising a plate adapted to be mounted on a head pole, on each side of a horse, during training, the plate having a plurality of regularly-spaced pins projecting therefrom, said pins being contained within a sponge-like material, either natural or artificial, whereby when pressure is urged against the sponge-like material, said pins are capable of projection therethrough.

A further object of the invention is to provide a pair of pressure plates for mounting on head poles of a horse during training, to train the horse to maintain its head and neck in alignment with its body.

A principal object of the invention is to provide a horse training pressure plate comprising a flat backing plate; a pad of sponge-like material affixed to one side of said backing plate; a plurality of pins of slightly lesser length than the thickness of said pad, projecting from said backing plate within said pad; and mounting brackets on the side of said backing plate opposite said pad.

The invention will be described with reference to the accompanying drawings in which.

Referring now in detail to the drawings, like reference numerals will be used to identify like parts.

Figure 4:
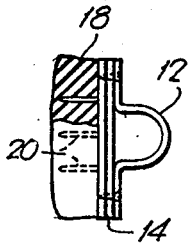
FIG. 4 is a section taken along line 4—4 of FIG. 3.
Figure 1:
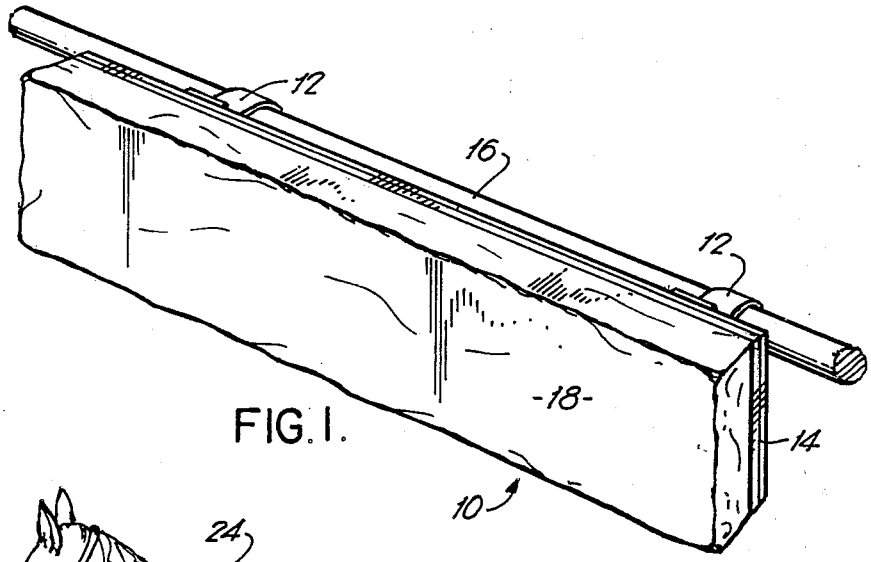
FIG. 1 is an isometric of an instructor plate mounted on a head pole.

A pressure plate according to the invention is indicated generally in FIG. 1 by reference numeral 10. A pair of brackets 12 are affixed to a backing plate 14, and brackets 12 are adapted for engagement with a head pole 16. A sponge-like pad 18 is affixed to backing plate 14. Projecting from backing plate 14, within sponge pad 18 are a plurality of pins 20, and as seen most clearly in FIGS. 2 and 4 pins 20 are of slightly lesser length than the thickness of pad 18.

Thus, as pressure is applied to the face of pad 18 remote from backing plate 14, pins 20 will project therethrough.

Figure 5:
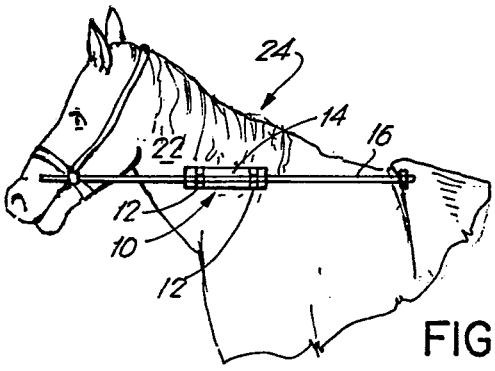
FIG. 5 is a side view of a horse's head and neck with a pressure plate according to the invention mounted on a head pole.

As seen in FIG. 5, pressure plate is mounted on head pole 16 adjacent the neck 22 of a horse 24. A corresponding pressure plate is mounted on the head pole on the side opposite of the horse's neck 22. Thus, providing the horse maintains its neck and head in alignment with its body, pad 18 will press slightly, but comfortably against neck 22. Should the horse turn its neck or head slightly either left or right pins 20 will be caused to project through sponge pad 18, to press against the neck skin of horse 24, to cause greater or lesser discomfort, depending on the degree of turn of neck 22 of horse 24.

Figure 2:
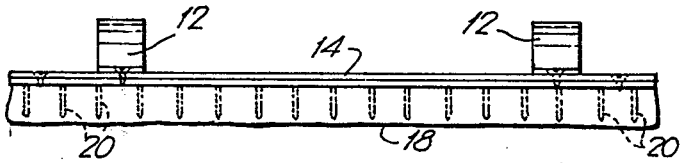
FIG. 2 is a top plan of a pressure plate with interior pins shown in broken lines.
Figure 3:
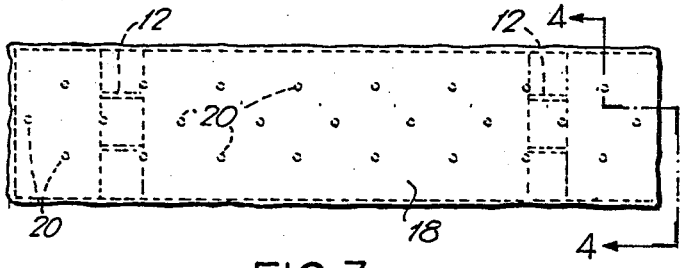
FIG. 3 is a front elevation of a pressure plate with pins and mounting brackets shown in broken lines.

As seen most clearly in FIG. 2 pins 20 are provided with slightly rounded pointed ends, so as to minimize the possibility of puncturing the skin of the horse's neck 22, but are sufficiently pointed to cause relative discomfort as the horse presses thereagainst.

The foregoing is by way of example only and the invention should be limited only by the scope of the appended claims.

The embodiments of the invention in which an exclusive property or privilege is claimed are defined as follows:

1. A horse training device comprising a flat backing plate;

a pad of sponge-like material affixed to one side of said backing plate;

a plurality of pins of slightly lesser length than the thickness of said pad, mounted on said backing plate so that their pointed ends are normally retained within said pad, said pad being compressible to expose the pointed ends of said pins; and mounting backets on the side of said backing plate opposite said pad for mounting said backing plate on a head pole whereby on turning of the head of the horse beyond a predetermined degree, the pad is compressed and the pointed ends exposed for contact with the horse's skin.

2. A horse training pressure plate according to claim 1, said pins being uniformly spaced apart within said pad.

3. A horse training device according to claims 1 or 2, said pins having slightly rounded pointed ends.

* * * * *